US006279623B1

(12) United States Patent
Smith

(10) Patent No.: US 6,279,623 B1
(45) **Date of Patent: *Aug. 28, 2001**

(54) ACTUATOR WITH A LONGITUDINAL FILLING PASSAGEWAY COMMUNICATING WITH EACH FORMED INTERNAL COMPARTMENT

(75) Inventor: Jeremy P. Smith, Loudon, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/662,739

(22) Filed: Sep. 15, 2000

Related U.S. Application Data

(62) Division of application No. 09/292,473, filed on Apr. 15, 1999, now Pat. No. 6,161,599.

(51) Int. Cl.[7] ..... B65B 1/04

(52) U.S. Cl. ..... 141/20; 141/3; 222/402.1; 222/402.16; 222/394

(58) Field of Search ..... 141/2, 3, 9, 18, 141/20, 100; 222/402.1, 402.16, 394

(56) References Cited

U.S. PATENT DOCUMENTS

| | | |
|---|---|---|
| 2,708,347 | 5/1955 | Cameron . |
| 2,731,298 | 1/1956 | Green . |
| 2,815,889 | 12/1957 | Stetz et al. . |
| 2,933,222 | 4/1960 | Waldherr . |
| 2,952,278 | 9/1960 | Waldherr . |
| 3,055,560 | 9/1962 | Meshberg . |
| 3,103,956 | 9/1963 | Focht . |
| 3,122,180 | 2/1964 | Abplanalp . |
| 3,158,298 | 11/1964 | Briechle . |
| 3,160,182 | 12/1964 | O'Donnell . |
| 3,173,457 | 3/1965 | Focht . |
| 3,176,727 | 4/1965 | Rousseau . |
| 3,179,132 | 4/1965 | Focht . |
| 3,237,659 | 3/1966 | Albrecht . |
| 3,319,669 | 5/1967 | Abplanalp . |
| 3,348,587 | 10/1967 | Grothoff . |
| 3,375,957 | 4/1968 | Kuffer . |
| 3,438,610 | 4/1969 | Hug . |
| 3,459,244 | 8/1969 | Riccio . |
| 3,556,173 | 1/1971 | Grothoff . |
| 3,604,477 | 9/1971 | Grothoff . |
| 3,680,605 | 8/1972 | Nigro . |

FOREIGN PATENT DOCUMENTS

| | | |
|---|---|---|
| 2 246 605 | 2/1992 | (GB) . |
| WO 81/01695 | 6/1981 | (WO) . |
| WO 83/02437 | 7/1983 | (WO) . |
| WO 84/01356 | 4/1984 | (WO) . |
| WO 86/06701 | 11/1986 | (WO) . |

*Primary Examiner*—Steven O. Douglas
(74) *Attorney, Agent, or Firm*—Davis & Bujold, P.L.L.C.

(57) ABSTRACT

An actuator for facilitating filling of an aerosol contain by a button-on-filling process, the actuator comprising an exterior housing having an outer wall with a product discharge outlet formed therein. The exterior housing further having central post supporting an internal bore which establishes fluid communication between a product inlet and the product discharge outlet to facilitate dispensing an aerosol product via the actuator. At least two spaced apart reinforcement ribs are provided for interconnecting the exterior housing with the central post and thereby define at least two compartments where any remaining filling component may collect. A base of the exterior housing has an annular skirt portion which facilitates sealing engagement with a pedestal portion of a mounting cup during a filling operation. A longitudinal passageway communicates with each formed compartment, of the actuator, to facilitate complete purging of any remaining filling component, during a purging step of the button-on-filling process, from each formed compartment to essentially prevent the discharge of any remaining filling component into a surrounding production facility environment.

22 Claims, 8 Drawing Sheets

U.S. PATENT DOCUMENTS

| | | |
|---|---|---|
| 3,713,464 | 1/1973 | Nigro . |
| 3,838,799 | 10/1974 | Meurfsch et al. . |
| 3,845,887 | 11/1974 | Meuresch et al. . |
| 4,148,419 | 4/1979 | MacNair . |
| 4,463,784 | 8/1984 | Butcher et al. . |
| 4,503,999 | 3/1985 | MacNair et al. . |
| 4,915,266 | 4/1990 | Knickerbocker . |
| 4,958,757 | 9/1990 | Greenebaume, II . |

ACTUATOR WITH A LONGITUDINAL FILLING PASSAGEWAY COMMUNICATING WITH EACH FORMED INTERNAL COMPARTMENT

This is a divisional of U.S. patent application Ser. No. 09/292,473 filed Apr. 15, 1999 now U.S. Pat. No. 6,161,599.

FIELD OF THE INVENTION

This invention relates to an improved actuator for a pressurized aerosol valve. According to a first aspect of the invention, it relates to an improved actuator having a relatively softer plastic material or laminate permanently secured to a downwardly facing bottom skirt surface thereof, for engaging with a top surface of a mounting cup, during charging of an aerosol container with pressurized components, to provide an improved seal between the skirt of the actuator and the top surface of the mounting cup. According to a second aspect of the invention, it relates to an improved actuator having a charging arrangement which facilitates substantially complete purging of all of the pressurized charging components from the interior of the actuator, with an inert gas, to minimize discharge of the toxic filling components into the atmosphere of the production facility.

BACKGROUND OF THE INVENTION

A pressurized product conventionally consists of a container, usually a metal can, which contains a product to be dispensed and a propellant and further includes a valve for controlling the flow of the product to be dispensed by the propellant. The pressurized container typically has the propellant supplied thereto by one of two process.

The first process is the under-the-valve-cup process. The under-the-valve-cup process supplies the propellant to the container before the mounting cup is affixed to the container. This process generally has known drawbacks and shortcomings with the major disadvantage of the under-the-valve-cup process being that it typically has a great loss of the propellant in comparison to the second process, i.e. the pressure filling process. In recent years, there has been a significant trend toward the pressure filling process for filling cans or containers. Currently, a majority of the billions of aerosol containers, which are filled yearly, utilize the pressure filling process.

According to this pressure filling process, the propellant is filled through the valve and then an actuator is subsequently installed on the valve. Alternatively, the container can be filled or charged with the actuator already installed on the valve.

The later pressure filling process is historically known as the button-on-filling (BOF) process. The advantage of the BOF process is that the purchaser of the valves is able to eliminate the step of installing the actuator on the valve, during the production operation, as it has already been previously installed by the valve assembly manufacturer.

One major difficulty encountered in pressurizing a container is achieving a sufficient seal between the filling or charging head, the actuator or spray button and the valve/mounting cup. Past designs employed a special sealing configuration located on the skirt of the actuator facing the top surface of the mounting cup. The pressure required for efficiently filling a container can reach as high as 60 atmospheres (900 psig). To compensate for such high pressures, the actuator recently has been made of a relatively soft material, such as polyethylene, in order to facilitate achieving a suitable seal between the actuator and the top portion of the mounting cup. The need to achieve an improved seal, during pressurization, is more important now because the pressurizing component (e.g. the gas) has been changed, in most manufacturing process, from chlorofluorocarbon (CFC) to hydrocarbons, which are flammable.

One drawback associated with using a softer material to manufacture the actuator is that the softer material has forced a compromise with respect to other functional aspects and considerations of the valve assembly. The softer material requires that a thicker walled, heavier spray actuator to be molded at slower production rates and at higher production costs. The use of the softer material also increases the cost of the actuators and the costs of the injection mold design and the construction as well as the maintenance of the injection molding equipment.

Despite various past efforts, directed at providing an adequate seal between the actuator and the mounting cup, it is still frequently necessary, during pressurization of a container, to increase the downward force of the filling or charging head to seal properly the actuator with the mounting cup. The resulting shortcoming is that the increased load may cause the mounting cup to be depressed excessively, thereby resulting in permanent deformation of the mounting cup. The excessive depression of the mounting cup pedestal may, in turn, produce unwanted side effects, e.g. leakage of the valve, etc.

A further problem of the prior art filling processes is that they tend to employ actuator designs which have one or more areas or cavities, within the interior of the actuator, which can trap and/or store a small quantity of the pressurized charging components and render it difficult to purge such trapped pressurized charging components from the actuator during a subsequent purging step. These trapped pressurized charging components are then immediately released directly into the production facility atmosphere, following completion of the charging process and separation of the charging head from the actuator. The direct release of the trapped pressurized charging components in the production facility atmosphere poses a safety hazard to the production workers and the environment.

SUMMARY OF THE INVENTION

Wherefore, it is an object of the present invention to overcome the aforementioned shortcomings and drawbacks associated with the prior art actuator and mounting cup designs.

Another further object of the invention is to provide a relatively softer plastic layer, material, member or laminate to a bottom downwardly facing surface of the actuator so as to allow the relatively softer plastic layer, material, member or laminate of the actuator to sufficiently deform and effectively seal against the upwardly facing surface of the mounting cup.

A further object of the invention is to provide a superior seal between a base of the skirt of the actuator and top outwardly facing surface of the mounting cup to facilitate the manufacture of a major portion of the actuator from a harder, thinner walled and lighter weight material and the lower portion of the skirt from a relatively softer plastic layer, material or laminate.

Yet another object of the invention is to provide an improved seal between a base of the actuator and the top surface of the mounting cup so that an increased pressure may be utilized during the filling process and thereby minimize the time for filling each pressurized container.

A still further object of the invention is to simplify the actuator geometry so as to reduce the associated costs in the design, the construction and the maintenance of the injection molding equipment for producing the actuator.

Still another object of the invention is to provided a suitable rigid thin wall plastic actuator that has a thicker wall resilient material located at a base of the skirt to minimize the leakage of pressurized fluid between the charging head, the actuator and the associated mounting cup during pressurizing filling of a container via the button-on-filling process.

A further object of the invention is to provide a superior seal between both the charging head and the exterior surface of an upper lip of the actuator, and the bottom surface of the lower lip of the actuator and a top outwardly facing surface of the mounting cup to minimize leakage of any pressurized charging components between the pressurize head/actuator/mounting cup interfaces when pressurizing a container by the button-on-filling process.

Yet another object of the invention is to provide pressurized filling flow path, through the actuator, which eliminates the formation of any areas or cavities, within the interior of the actuator, where pooling, collection and/or storage of any of the pressurized charging components can occur, during the filling process, thereby facilitating a complete purging of all of the pressurized charging components following completion of the charging step. A still further object of the invention is to provide an increased number of flow paths, for conveying the pressurized charging components through the actuator, to minimize the time required for filling a desired aerosol container.

Another object of the invention is to provide an actuator that does not facilitate collection of any of the filling components within the interior head space of the actuator and thereby minimize the escape of any of the pressurized charging components, into the surrounding environment, following completion of the charging process and removal of the charging head.

A further object of the invention is to provide an actuator that does not allow any pressurized charging components to collect or pool within any interior cavity, recess, port or head space of the actuator thereby minimizing the possibility that such pressurized charging components cannot be completely purged from the actuator when an inert purging gas is supplied following completion of the charging process.

A still further object of the invention is to increase the number of charging flow paths and thereby increase the cross sectional area of the flow paths, so as to decrease the filling time associated with filling a container by the improved actuator according to the present invention.

Yet another object of the invention is to facilitate complete purging of any trapped or residual pressurized charging components from the actuator, via a purging inert gas, to minimize the possibility of any hazardous material(s) being discharged into the surrounding environment following completion of the button-on-filling process.

Still another object of the invention is to facilitate successful pressure filling, with the actuator installed on the valve, regardless of variations in the filling or charging equipment, the actuator, the valve mounting cup and/or other variables which occur during the pressure filling process.

The present invention relates to a actuator for facilitating filling of an aerosol contain by a button-on-filling process, said actuator comprising: an exterior housing having an outer wall with a product discharge outlet formed therein, said exterior housing further having central post supporting an internal bore establishing communication between a product inlet and said product discharge outlet to facilitate dispensing an aerosol product via said actuator, at least two spaced apart reinforcement ribs interconnecting said exterior housing with said central post and thereby defining at least two internal compartments; a base of said exterior housing having an annular skirt portion for facilitating sealing engagement with a pedestal of a mounting cup during a button-on-filling process; and at least two longitudinal passageways for facilitating filling of an pressurizable container, via said actuator, during by a button-on-filling process; wherein each formed internal compartment of said actuator communicates with one of said at least two longitudinal passageways to facilitate purging of any remaining filling component from each formed internal compartment, during a purging step of the button-on-filling process, to minimize discharge of any remaining filling component into a surrounding production facility environment following completion of the button-on-filling process.

The present invention also relates to a pressurized container comprising a base portion and a side wall terminating at a rim, a mounting cup having a centrally located aperture being surrounded by a pedestal, said mounting cup including a perimeter curl being attached said rim; a valve assembly being crimped to said mounting cup so as to be permanently retained thereby with an upstanding valve stem extending through said central aperture, and said upstanding valve stem having a valve product outlet; an actuator having an exterior housing with an outer wall having a product discharge outlet formed therein, said exterior housing further having an internal bore establishing communication between a product inlet of said actuator and said product discharge outlet of said actuator for facilitating dispensing an aerosol product via said actuator, a base of said exterior housing having an annular skirt portion for facilitating sealing engagement with the pedestal of a mounting cup during a filling operation; said valve stem frictionally engaging with said product inlet of said actuator to establish a product flow path therebetween; said valve assembly having a valve product inlet communicating with said valve product outlet for supplying product to be discharged through said valve assembly; and said valve assembly accommodating a normally closed valve element for controlling the flow of product from said valve product inlet to said valve product outlet; wherein at least said annular skirt portion, provided for engaging with a mounting cup during a filling operation, is formed from a softer material than a remainder of said actuator to facilitate sufficient deformation of said annular skirt portion, during a filling operation, and formation of an adequate seal with a mounting cup.

The present invention finally relates to a process of charging a pressurized container with propellant, said process comprising the steps of: supporting a valve assembly via a mounting cup; installing an actuator with an exterior housing having an outer wall with a product discharge outlet formed therein, said exterior housing further having central post supporting an internal bore establishing communication between a product inlet and said product discharge outlet to facilitate dispensing an aerosol product via said actuator interconnecting said exterior housing with said central post with at least two spaced apart reinforcement ribs thereby to define at least two internal compartments; providing a base of said exterior housing with an annular skirt portion for facilitating sealing engagement with a pedestal of a mounting cup during a button-on-filling process; providing at least two longitudinal passageways for facilitating filling of an aerosol contain by the button-on-filling process; securing said mounting cup to a base container via a crimping process to form a pressurizable container; biasing a base of said actuator, via a charging head, into contact with a top surface of said mounting cup to provide a seal therebetween during the button-on-filling process; supplying at least one pressurized component from said charging head to an interior of said pressurizable container, along at least one flow path, to form said pressurized container; and prior to withdrawing said charging head from said actuator, supplying a purging gas to said actuator to purge any remaining filling component from each formed internal compartment to purge any remaining filling component therefrom and minimize discharge of the at least one pressurized component into a surrounding production facility environment.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
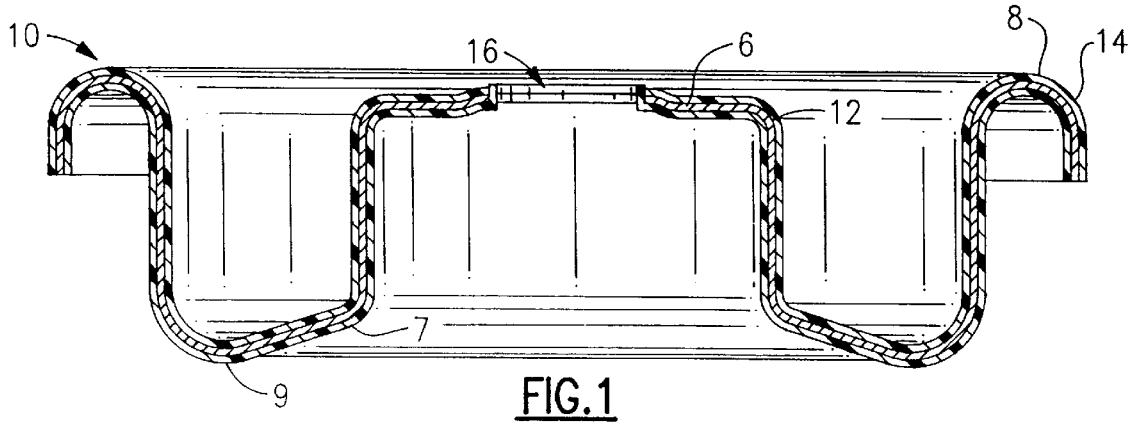
FIG. 1 is a diagrammatic transverse cross-sectional view of a conventional mounting cup.

Turning now to FIG. 1, a conventional mounting cup will now be briefly described. As can be seen in FIG. 1, the mounting cup is formed from a base metal such as steel. A top surface 6 of the mounting cup 10 may be laminated with an outwardly facing soft plastic film 8, such as polyethylene, high density polyethylene, polypropylene, etc. A bottom surface 7 of the mounting cup 10 may also be laminated with an inwardly facing soft plastic film 9, such as polyethylene, high density polyethylene, polypropylene, etc. The purpose of the plastic film 9 on the bottom inwardly facing surface 7 of the mounting cup 10 is to form a suitable seal between the mounting cup and a base container when the mounting cup 10 is crimped to the container in a conventional manner. As the feature of providing the plastic film 9 on the bottom surface of the mounting cup is well known in the art, a further detailed discussion concerning the same is not provided.

Figure 2:
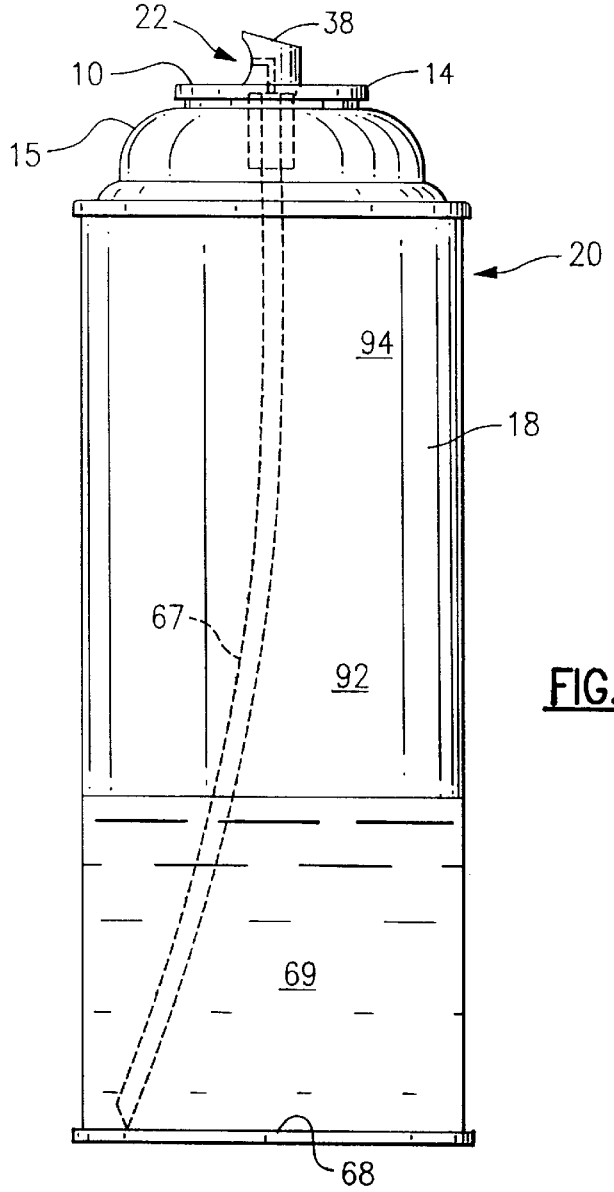
FIG. 2 is a diagrammatic elevational view of a pressurized container containing a vertical spray valve.

The mounting cup 10 is provided with a pedestal 12 as well as a peripheral mounting cup curl 14 for crimping, in a conventional manner, to a perimeter rim of a metal can or some other pressurizable container or to a dome member 15 of a three piece container (FIG. 2). In addition, an aperture 16 is centrally located within the pedestal portion 12 for allowing a stem of a valve assembly to extend therethrough to facilitate actuation of the valve and dispensing of product.

FIG. 2 shows a conventional mounting cup 10 installed on a base container 18 to form a pressurizable container 20. As can be seen in this Figure, an actuator assembly 22, with a vertical valve and an actuator 38, was crimped to the pedestal portion of the mounting cup 10 and the peripheral mounting cup curl 14 is crimped to the rim to form the pressurizable container 20.

Figure 3:
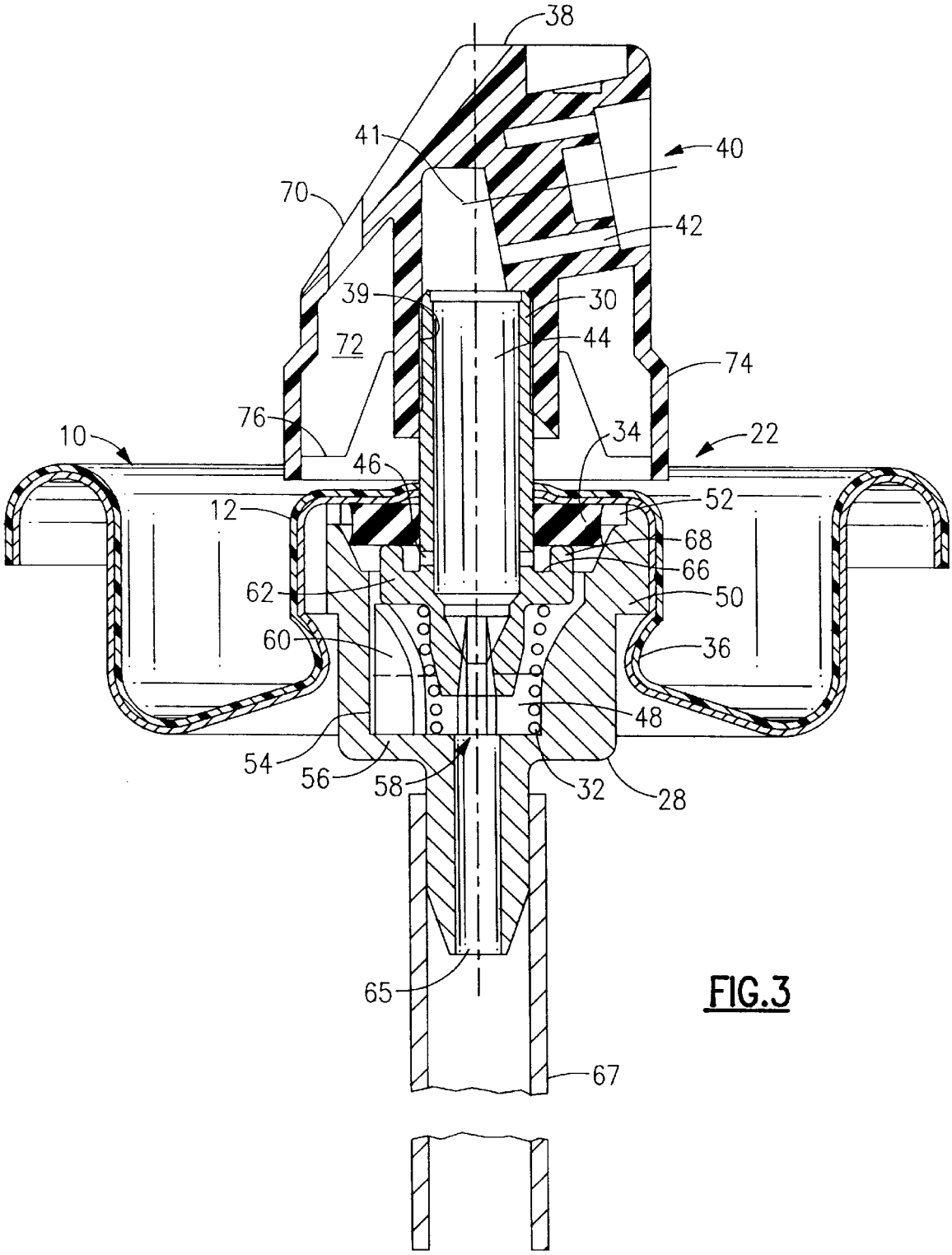
FIG. 3 is a diagrammatic cross-sectional view showing a tilt valve assembly installed on a mounting cup.
Figure 4:
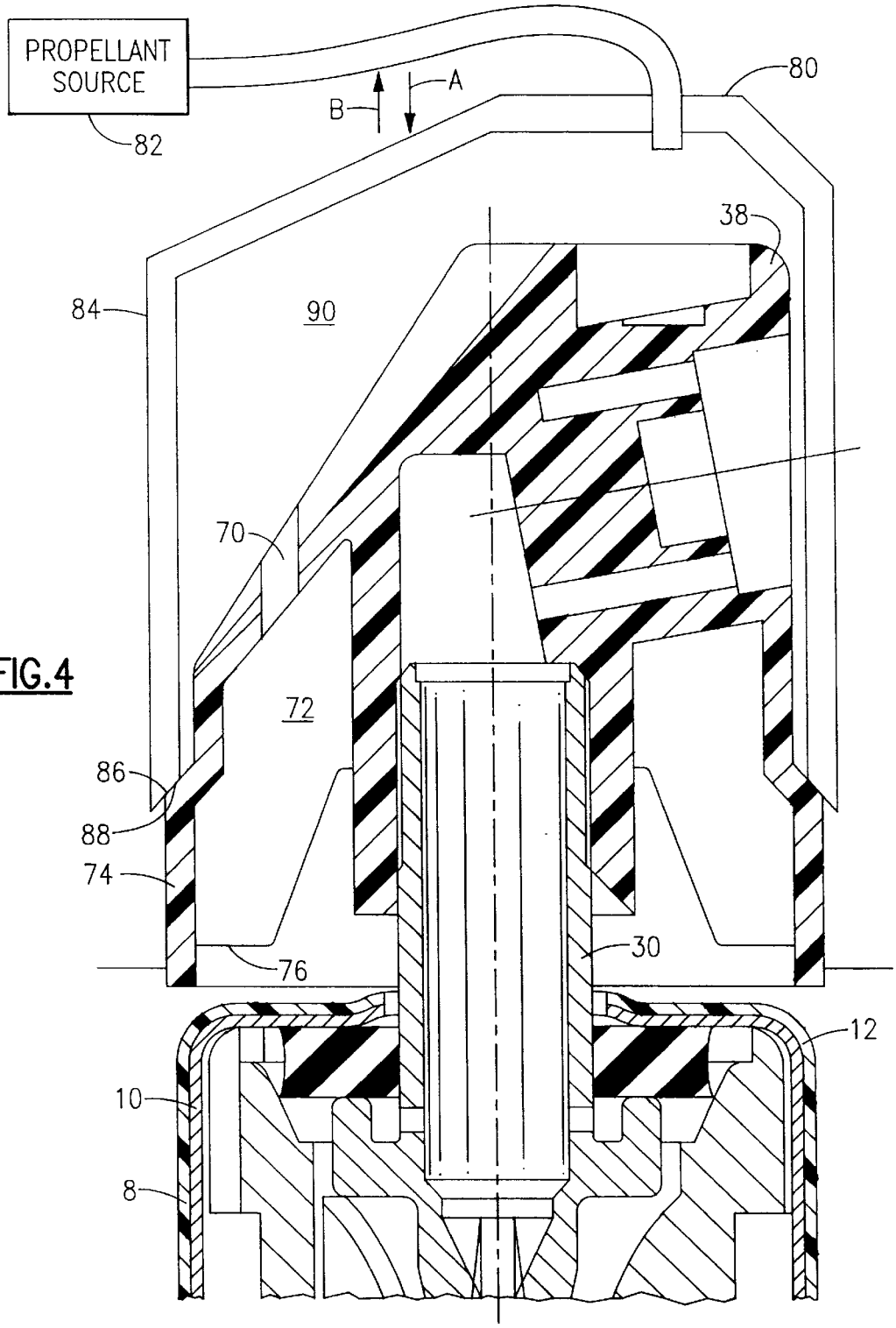
FIG. 4 is a partial diagrammatic cross-sectional view showing the initial engaged position between the charging head and the actuator of assembly.
Figure 5:
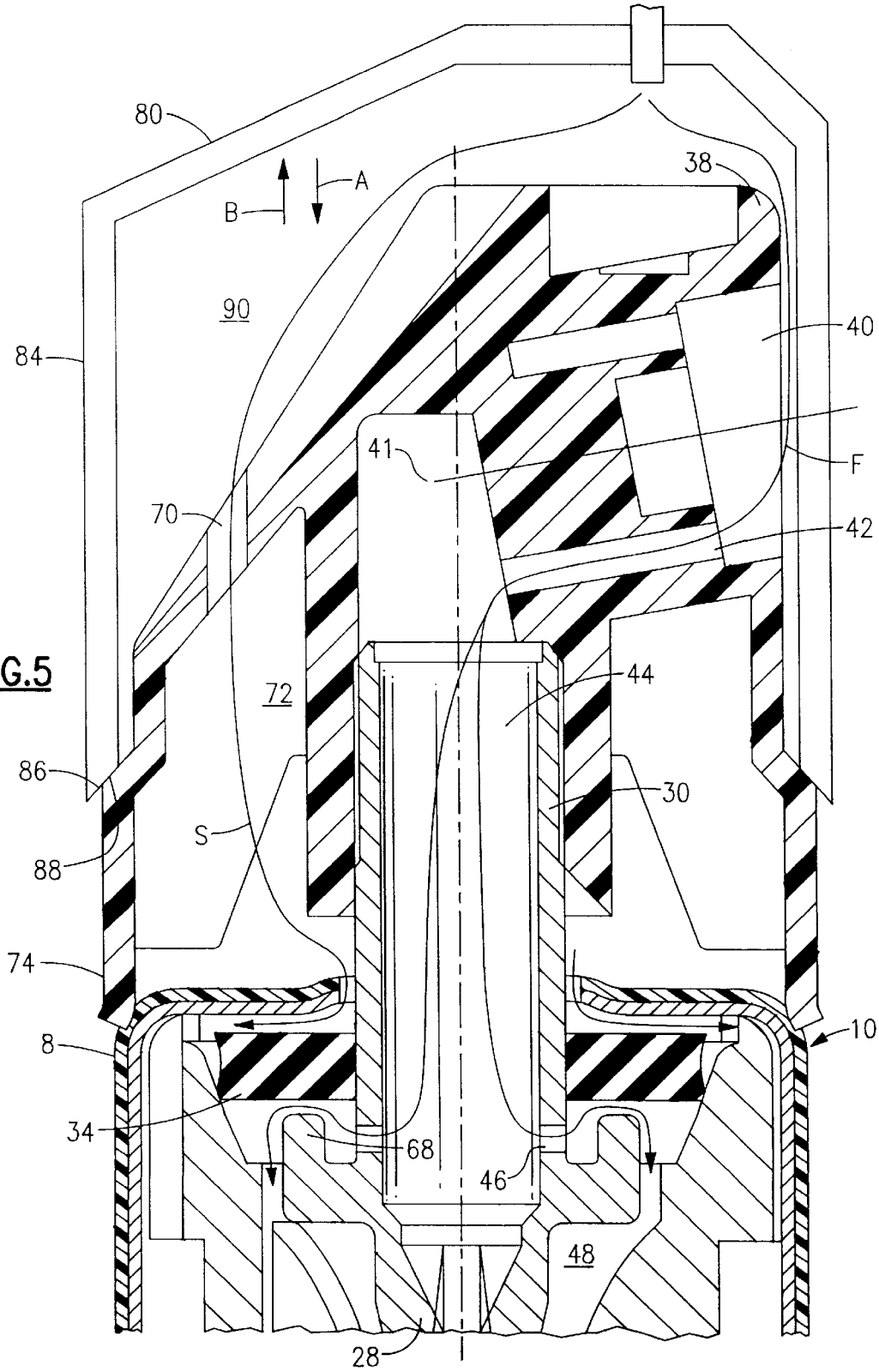
FIG. 5 is a partial diagrammatic cross-sectional view, of the tilt valve assembly of FIG. 4, showing the fully depressed position of the charging head for filling the pressurized container with propellant.

Turning now to FIGS. 3–5, a detailed description concerning the mounting cup 10 and the valve assembly 22, for installation on the base container 18, will now be provided. As can be seen in FIG. 3, the mounting cup 10 supports an actuator assembly 22. The actuator assembly 22 comprises a valve body 28 supporting an upstanding valve stem 30, a biasing spring 32, and a gasket 34. The biasing spring 32 and gasket 34 are assembled within the valve body 28 and the valve body 28 is clamped to the mounting cup 10 by means of a plurality of indentations or crimps 36, e.g. four indentations or crimps formed inwardly from the exterior of the side wall of the pedestal portion 12. The crimping operation forces the valve body 28 upward to bias and compressively seal the gasket 34 against the inwardly facing surface of the mounting cup 10. The valve stem 30 protrudes through the central aperture 16 provided in the pedestal portion 12 of the mounting cup 10. An actuator 38, with a central post with a produce inlet or aperture 39, is frictionally fitted over the exterior surface of the upstanding valve stem 30.

The valve stem 30 includes a central bore 44 having one end which communicates with a discharge outlet 40 of the actuator 38 via a button cavity 41 and at least one supply passageway 42. The opposite end of the central bore 44 communicates with at least one transverse passageway 46, and possibly two (as shown in the Figures) or three equally spaced transverse passageways, which are temporarily blocked by the gasket 34, when the valve is in its biased normally closed position, as can be seen in FIG. 3. When the valve is sufficiently depressed, communication is established between the transverse passageway 46 and an interior valve cavity 48 of the valve body 28 for discharging the product contents from the container 20 and for supplying propellant and/or product to the container 20 during the charging process (see FIG. 5).

The valve body 28 has a thickened mouth 50 which is provided with a plurality of castellations 52 therearound. The valve body 28 also includes a side wall 54 and a floor 56 which is provided with a central aperture 58. A plurality of locator ribs 60 are molded inside the valve body 28 between the floor 56 and the side wall 54. These locator ribs 60 serve to strengthen the floor and also center the lower portion of the spring 32. During the crimping operation with the pedestal 12, the plurality of indentations or crimps 36 engage a lower portion of the thickened mouth 50 to force the valve body 28 upwardly so as to compress and seal the gasket 34 against the inwardly facing surface of the mounting cup.

The valve stem 30 includes an enlarged head 62 which is formed at the lower end of the valve element and centrally connected to the valve stem 30. An annular recess may be provided on the underside of the head 62, to receive and center a top portion of the spring 32, and the upper surface 66 of the head is provided with an annular sealing rib 68 which seats against the lower or downwardly facing surface of the gasket 34. The transverse passageways 46 are located adjacent the head 62 and are normally closed off by the annular sealing rib 68 abutting against the gasket 34 when the valve element is in its biased, normally closed position, as can be seen in FIG. 3.

The spring 32 is compressibly disposed between the floor 56 and the enlarged head 62 to urge the valve element away from the floor 56. For dispensing purposes, the described valve operates in a conventional fashion.

A product dip tube 67 is fitted to the lower end of the valve body 28 and surrounds a product inlet 65. A lower end of the product dip tube 67 communicates with the base 68 of the pressurized container (FIG. 2) to facilitate discharging the product contents 69. Upon depression of the actuator 38, the valve stem 30 compresses the spring 32 which allows the product contents 69 to flow up through the dip tube 67 into the valve cavity 48. The product contents 69 then flow between an inwardly facing surface of the valve body 28 and the enlarged head 62 of the valve stem 30. The contents then flow radially, between the gasket 34 and the annular sealing rib 68, through transverse passageways 46 into central bore 44 and are supplied to the actuator via the opening of the valve stem 30. The supplied product is conveyed to discharge outlet 40, via button cavity 41 and passageway 42, and thereafter discharged directly into the atmosphere. If desired, a conventional insert member 45 (see FIG. 12), having centrally located discharge orifice therein for imparting the desired spray formation of the product to be dispensed, may be located within by the discharge outlet 40 to facilitate discharge of the aerosol product in a desired spray configuration or pattern. As the insert member 45 is conventional and well known in the art, a further detailed description concerning the same is not provided.

For filling the container with a desired propellant and/or product, a product charging path is established through at least one longitudinal passageway (opening) 70, provided in the actuator 38 at a location remote from the discharge outlet 40, which communicates with an interior chamber 72 defined by actuator 38. The interior chamber 72 of the actuator is provided with at least one and preferably a plurality of stop members or reinforcement ribs 76, e.g. three or four equally spaced stop members or reinforcement ribs, which have a bottom edge spaced a suitable distance from the bottom or base of a skirt 74. During depression of the actuator 38, a base of the stop members or reinforcement ribs 76 are located to engage with a top surface of the mounting cup 10 and prevent further downward movement of the actuator and thereby to prevent damage to the valve assembly 22 due to an over stroke of the valve. The longitudinal passageway 70 and interior chamber 72 are utilized for filling the pressurized container with a propellant and/or product and the process for charging the pressurized container with propellent and/or product will now be described in detail with reference to FIGS. 4 and 5.

A charging head 80 is connected to a source product and/or propellant 82 under relatively high pressure, e.g. 900 psig, and the charging head 80 is located to completely surround and closely encompass the actuator 38 to facilitate charging of the pressurized components. The charging head 80 has a side wall 84 provided with an inwardly facing tapered flange 86. The flange 86 is arranged to engage a mating outwardly facing tapered flange 88 provided on the exterior surface of the actuator 38 forming a portion of the skirt 74. As the charging head 80 is lowered into engagement with the actuator 38, the flange 86 engages with the mating flange 88 of the actuator 38 and forms a suitable seal therewith. Further lowering motion of the charging head 80, in the direction of arrow A, forces a base of the skirt 74 of the actuator 38 into engagement with the top outwardly facing surface of the mounting cup 10 (FIG. 5).

The charging head 80 is designed to force a lower most or base surface of the skirt 74 of the actuator 38 into intimate sealing contact with a top upwardly facing surface of the mounting cup 10. As can be seen in FIG. 5, the base of the skirt 74 bites, to a small degree, into the soft plastic film 8, provided on the top surface 6 of the mounting cup 10, to provide a suitable seal fluid tight seal between those two components. A second seal is also provided between the mating flanges 86, 88 of the charging head 80 and the actuator 38. By this arrangement, the charging head 80 is sufficiently sealingly engaged with the container 20 to prevent the inadvertent escape of propellant and/or product during the charging process. The disclosed engagement establishes at least two charging paths for charging the pressurized container with propellent.

A first charging path (see FIG. 5) extends from a charging head interior 90 through the discharge outlet 40, the passageway 42, the button cavity 41, the central bore 44, the transverse passageway(s) 46 into the cavity 48 along a flow path F. A second charging path is established through longitudinal passageways 70, provided in the actuator 38, to the interior chamber 72 along flow path S. From there, the propellent and/or product then flows through the aperture 16 of the mounting cup 10 along an exterior surface of the valve stem 30 and then flows between a top surface of the gasket 34 as it is at least partially spaced from an inwardly facing surface of the mounting cup 10, e.g. a few thousandths of an inch or so, to form a propellent and/or product flow path therebetween. The propellant and/or product continues to flow radially along the inwardly facing surface of the mounting cup 10, between the mounting cup 10 and the gasket 34, and then axially down along the inwardly facing surface of the mounting cup 10, between the mounting cup 10 and the exterior surface of the valve body 28, until the propellent and/or product reaches the interior 92 (FIG. 2) of the pressurized container 20.

Upon completion of the charging process, the charging head 80 is withdrawn, in the direction of arrow B, and the valve is allowed to return to its normal closed position, via spring 32, in which the gasket 34 abuts against the inwardly facing surface of the mounting cup 10 and the annular sealing rib 68 abuts against a lower or downwardly facing surface of the gasket 34 to prevent the inadvertent discharge of any of the product contents 69.

It is to be appreciated that the charging head 80 can also be used to pressurize a container with propellent and/or product, prior to installation of the actuator 38, by merely providing the charging head 80 with a mechanism located to adequately depress the actuatorless valve stem 30, during the charging process, while still allowing the propellant 94 and/or product 69 to be supplied through the central bore 44 of the stem.

Figure 7:
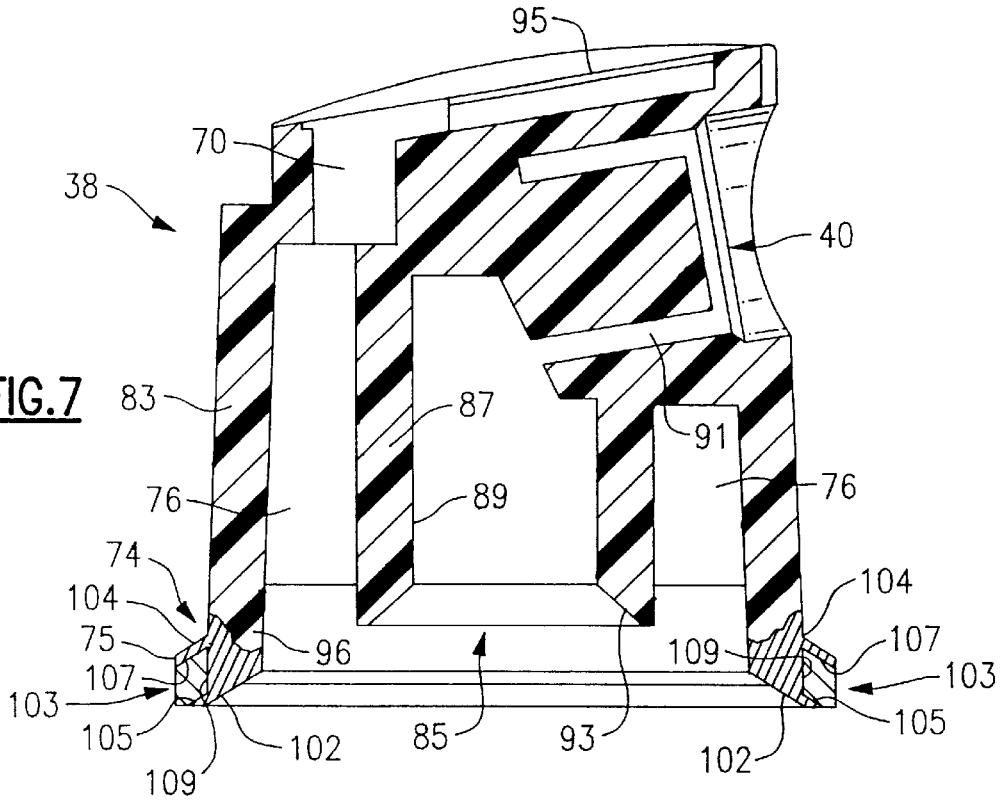
FIG. 7 is a diagrammatical cross sectional view along section line 7—7 of FIG. 6.
Figure 6:
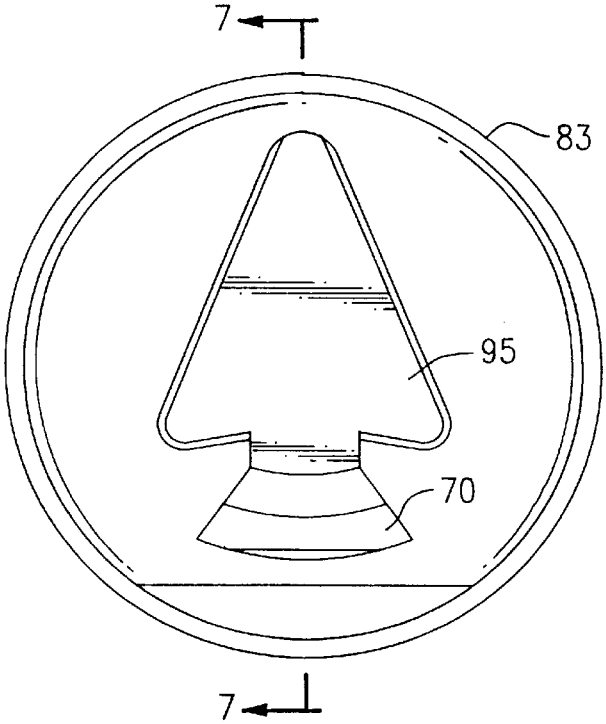
FIG. 6 is a diagrammatical top plan view of a first embodiment of the improved actuator according to the present invention.

Turning now to FIGS. 6 and 7, a detailed description concerning a first embodiment of the improved actuator, according to the present invention, will now be provided. The actuator 38 is generally formed of an exterior housing 83 which has a lower peripheral skirt 74 for engagement with a top surface of the mounting cup 10. The exterior housing 83 has a centrally located hollow post 87 provided with an actuator product inlet 85 for supplying product from the valve stem to the discharge outlet 40 of the actuator 38. The flow path generally comprises an internal central bore 89 which communicates with a radial bore 91 for supplying product to the discharged outlet 40 where the product contents are discharged from the actuator 38 into the environment. Alternatively, an insert member, with a centrally located discharge orifice, may be provided for ultimately discharging the product to be dispensed. It is to be appreciated that the discharge outlet 40 can have a variety of different shapes or configurations which are conventional and well known in the art. As such teach relating to the formation of the discharge outlet is well known in the art, a further detailed description concerning the same is not provided.

The product inlet 85 for the central bore 89 includes a chamfered surface 93 which facilitates engagement between the central bore 89 and an exterior surface of the stem 30 of an aerosol valve attached to the mounting cup 10 (see FIG. 3). A top surface of the actuator 38 is provided with a contour finger recess 95 for facilitating depression of the actuator 38 during dispensing of the product from the outlet of the valve through the central bore 89, the radial bore 91 and out through the discharge outlet 40 and insert member of the actuator 38.

As can be seen in FIG. 7, an important aspect of the present invention relates to the lower part or base of the skirt 74 which is provided For engagement with the top surface of the mounting cup 10. The lower portion of the exterior housing 83 has a downwardly extending leg or projection 96 which facilitates permanent mating engagement with a lower, relatively more resilient skirt portion 75. The downwardly extending leg or projection 96 is designed to facilitate secure attachment of the resilient skirt portion 75 to the actuator 38. The resilient skirt portion 75 comprises an annular skirt member which extends completely around the base of the exterior housing 83 of the actuator 38 and is designed to be at least partially compressed, during the button-on-filling process, to provide a suitable seal between the base of the actuator 38 and the top surface 6 of the mounting cup 10. To facilitate such a seal, it is to be appreciated that the resilient annular skirt portion 75 must be permanently or otherwise securely fastened to the leg or projection 96 of the lower peripheral edge of the exterior housing 83 of the actuator 38, e.g. to be made integral therewith by either gluing, welding, ultrasonic welding, etc.

The resilient skirt portion 75 has a pair of inwardly and outwardly facing and inclined substantially planar walls 102, 104 which extend parallel to one another and form an angle of approximately 110 to 160 degrees with a remainder of the exterior housing 83, more preferably form an angle of about 120 to 145 degrees with a remainder of the exterior housing 83, and most preferably form an angle of about 135 degrees with a remainder of the exterior housing 83. The pair of parallel and spaced apart side walls 102, 104 are separated from one another by an annular recess 103. The annular recess 103 is defined by a pair of inwardly facing substantially planar side walls 105, 107, which extend parallel to the pair of side walls 102, 104, and mate with a vertical end wall 109. The inclination of the pair of side walls 102, 104 of the resilient skirt facilitate the formation of an improved seal between the actuator 38 and top surface of the mounting cup 10. If desired, one of more internal ribs can interconnect with one another to provide additional support to the side walls 102, 104, 105, 107 of the resilient skirt 75. As can be seen in FIG. 7, preferably the base or bottom surface of the resilient skirt portion 75 is contoured, e.g. it is planar, so as to extend substantially parallel with a top portion of the pedestal 12 of the mounting cup 10 to facilitate a suitable seal therewith during the button-on-filling process.

According to a preferred form of the invention, the actuator 38 is injection molded on a specialized injection molding machine which manufactures the actuator in either a two shot process, e.g. the first major portion of the actuator 38 is molded from a relatively harder plastic material by the specialized injection molding machine during a first injection molding step and, following such molding step, the more resilient skirt 75 is next formed during a second molding step from a relatively softer material which is compatible with the relatively harder material. Alternatively, it is possible that the improved actuator 38, according to the present invention, can be injection molded by a co-extrusion process. As both of the above briefly described injection molding processes are conventional and fairly well known in the art, a further detailed description concerning the same is not provided. An important aspect of the present invention is that a major portion of the actuator 38 be manufactured from a material which is substantially rigid and thus allows thinner walls to be utilized as well as faster manufacturing rates of the actuator while the resilient skirt portion is manufactured from a soft, low density material which is capable of maintaining the desired seal with the charging head and the mounting cup.

The resilient skirt portion 75 of the actuator 38 is sized to have an inner perimeter dimension which is slightly smaller, e.g. about 0.040 inches (1.0 mm) or so, than an outer perimeter diameter of the pedestal portion 12 of the mounting cup 10. The reason for this is so that resilient skirt portion 75, when forced against the top outwardly facing surface of the mounting cup 10, during the charging process, sufficiently resiliently deforms to provide a fluid tight seal with the top outwardly facing surface of the mounting cup 10 which is able to withstand the contemplated filing pressures and prevent the escape of the pressurized charging components therebetween. The improved actuator, according to this embodiment, can mate directly either with the top metal surface of the mounting cup 10 or, if so desired, with a plastic film 8 supported by the top surface of the metal mounting surface 10.

By this arrangement, a sufficient seal between the skirt portion 75 and the top outwardly facing surface of the mounting cup 10 is achieved. Because of this improved seal, the present invention is able to utilize filling pressures on the order of 900 psig or so and fill the pressurized container 20, containing a product to be dispensed with an adequate amount of propellant 94 and/or product 69, within approximately two seconds or less at pressurized product filling rate of about 100 cubic centimeters per second.

In a preferred embodiment of the present invention, a major portion of the actuator 38, e.g. the entire the actuator except for the resilient annular skirt portion 75, is manufactured from a relative harder material, e.g. nylon, acetal, polypropylene, etc., so that all of the interior and exterior walls of the actuator can be made relatively thinner. The harder material allows the wall thickness to be reduced by approximately 33% over conventional actuators currently utilized, i.e. to utilize a wall thickness of about 0.030 inches (0.76 mm) to about 0.020 inches (0.51 mm). The resilient annular skirt portion 75, on the other hand, is manufactured from a relatively softer material such as low density polyethylene, high density polyethylene, thermoplastic rubber (T.P.R.), etc., to facilitate easy deformation of the same during the charging process.

Due to the disclosed arrangement, as the charging head 80 forces the resilient annular skirt portion 75 into contact with the upwardly facing surface of the mounting cup 10, during the charging process, the relatively softer resilient annular skirt portion 75, according to this embodiment, sufficiently deforms against the exterior surface of the mounting cup 10 to form a suitable fluid tight seal between those two components.

With reference to FIGS. 8–11, a detailed description concerning a second embodiment of the actuator, according to the present invention, will now be provided. As this embodiment is very similar to the previously discussed embodiment, a further detailed description concerning only the inventive aspects of the second embodiment will now be provided.

Figure 8:
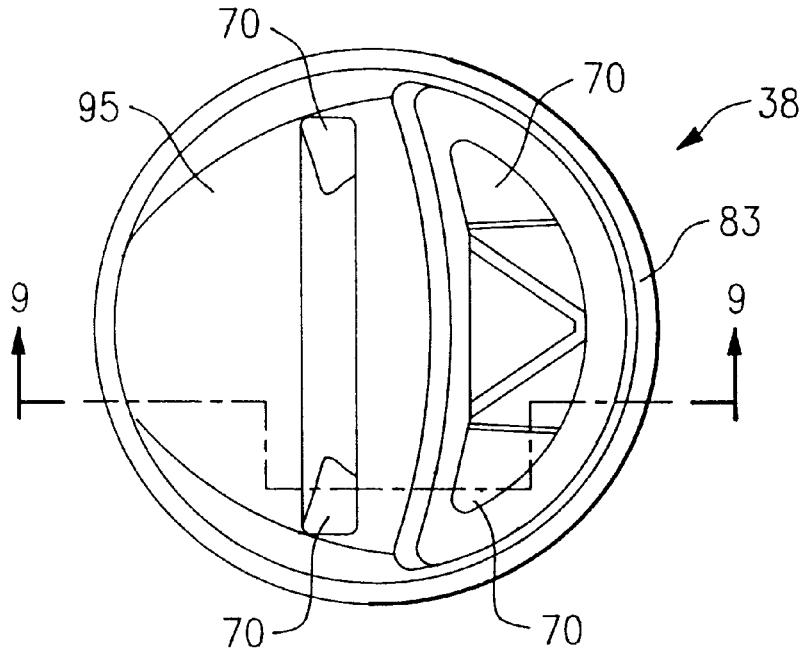
FIG. 8 is a diagrammatical top plan view of a second embodiment of the improved actuator according to the present invention.
Figure 9:
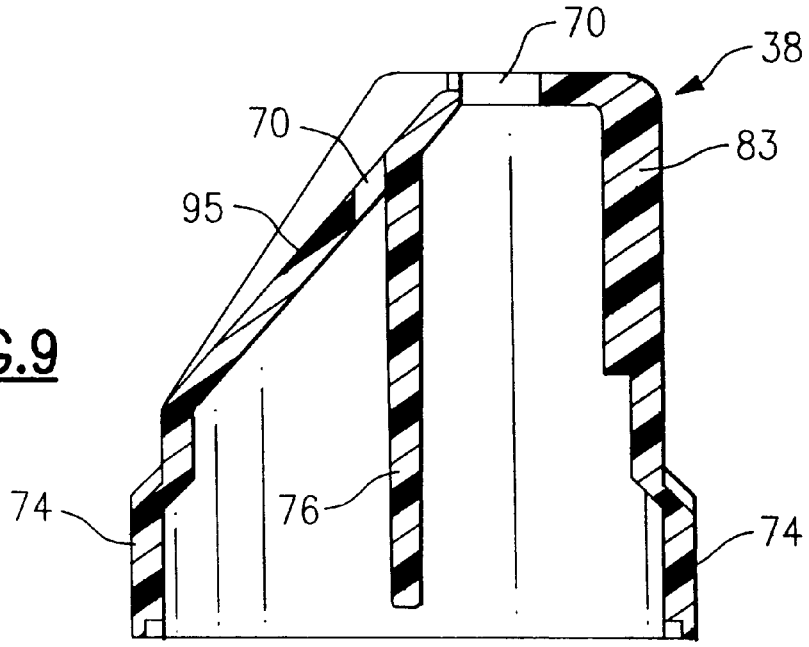
FIG. 9 is a diagrammatical cross-sectional view along section line 9—9 of FIG. 8.
Figure 11:
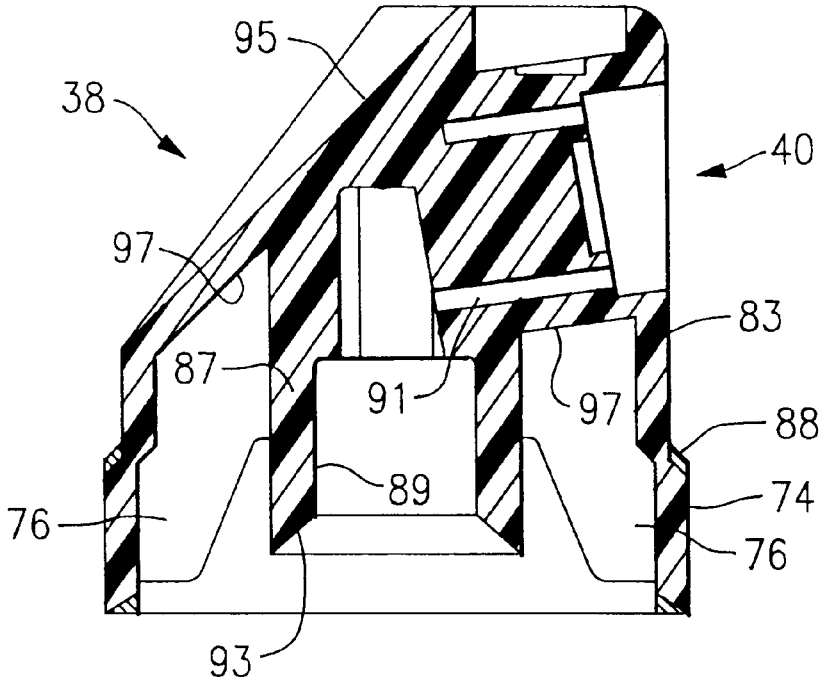
FIG. 11 is a diagrammatical cross-sectional view along section line 11—11 of FIG. 10.
Figure 10:
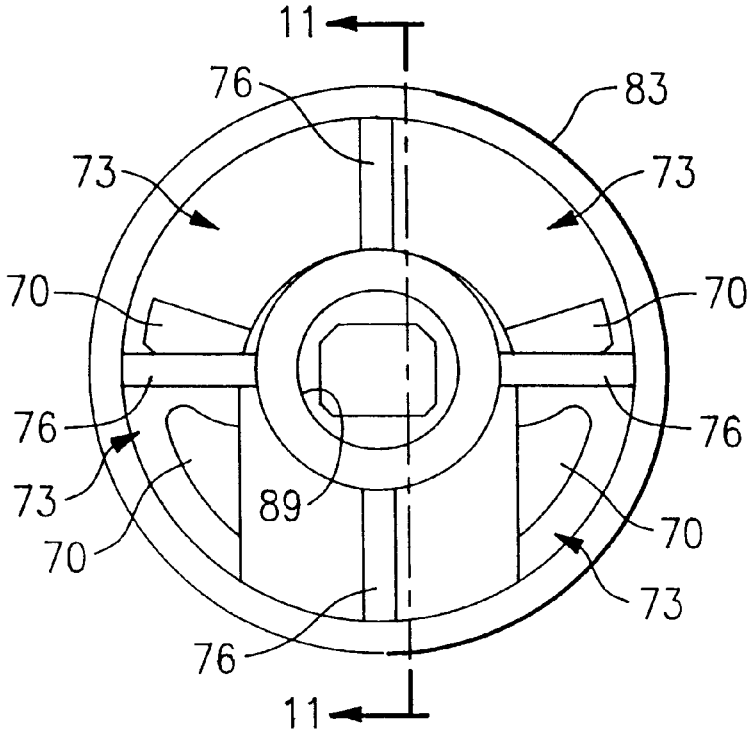
FIG. 10 is a diagrammatical bottom plan view of the actuator of FIG. 8.

As can be seen in FIGS. 8–11, the second embodiment of the improved actuator is also provided with an exterior housing 83 and a centrally located hollow post 87. The central post 87 has a central bore 89 (FIG. 11) communicating with a radial bore 91 for supplying product to a discharge outlet 40 of the actuator 38. An important feature of this design relates to the number and the location of the longitudinal passageways 70 provided in the actuator 38. As can be seen in FIGS. 8 and 10, four longitudinal passageways 70 are provided in this embodiment of the actuator 38. The reason for the increased number of longitudinal passageways 70 is that interior surface of the actuator has a total of four stop members or reinforcement ribs 76 (see FIGS. 10 and 11) which interconnect an exterior surface of the central post 87 of the actuator 38 with an inwardly facing surface of the exterior housing 83 of the actuator 38. These reinforcement ribs 76 reinforce the overall structure of the actuator 38 but, as can be seen in FIG. 10, also divide the interior chamber 72 of the actuator 38 into four separate cavities, recesses, pocket or internal compartments 73 where it is possible for some of the pressurized charging components to pool, collect and/or become trapped during the charging process. That is, if only two longitudinal passageways 70 were provided in the actuator 38 having four reinforcement ribs, as is conventionally done in the art, there are at least two formed cavities, recesses, pockets or compartments 73 where the pressurized charging components can readily pool, collect and/or accumulate during the charging process. Because of the inadequate design of the prior art actuators, the pooled, collected and/or accumulated pressurized charging components are not adequately purged, during a subsequent purging step, and thereafter these components are immediately released into the surrounding production environment. By providing a longitudinal passageway which communicates with each one of the formed cavities, recesses, pockets or compartments 73 defined by the adjacent pairs of reinforcement ribs 76, the exterior surface of the central post 89, the inwardly facing surface of the exterior housing 83, and a downwardly facing surface 97 of the actuator 38, the improved actuator 38 is designed so that there are virtually no area(s) where the pressurized filling components can readily collect, pool and/or accumulate and not be adequately purged, by the inert purging gas, during the subsequent purging step.

It is to be appreciated that, according to this second embodiment, the number of longitudinal passageways 70 is to equal the number of reinforcement ribs 76 extending between the exterior surface of the central post 87 and the inwardly facing surface of the exterior housing 83 of the actuator 38. That is, there is a longitudinal passageway 70 which communicates with each formed cavity, recess, pocket or compartment 73 of the actuator 38. By providing communication between each formed cavity, recess, pocket or compartment 73 and a longitudinal passageway 70, the inert purging gas is able to sufficiently purge all of the residual pressurized filling components from the actuator 38 prior to disengaging the charging head 80 from the actuator 38.

Figure 12:
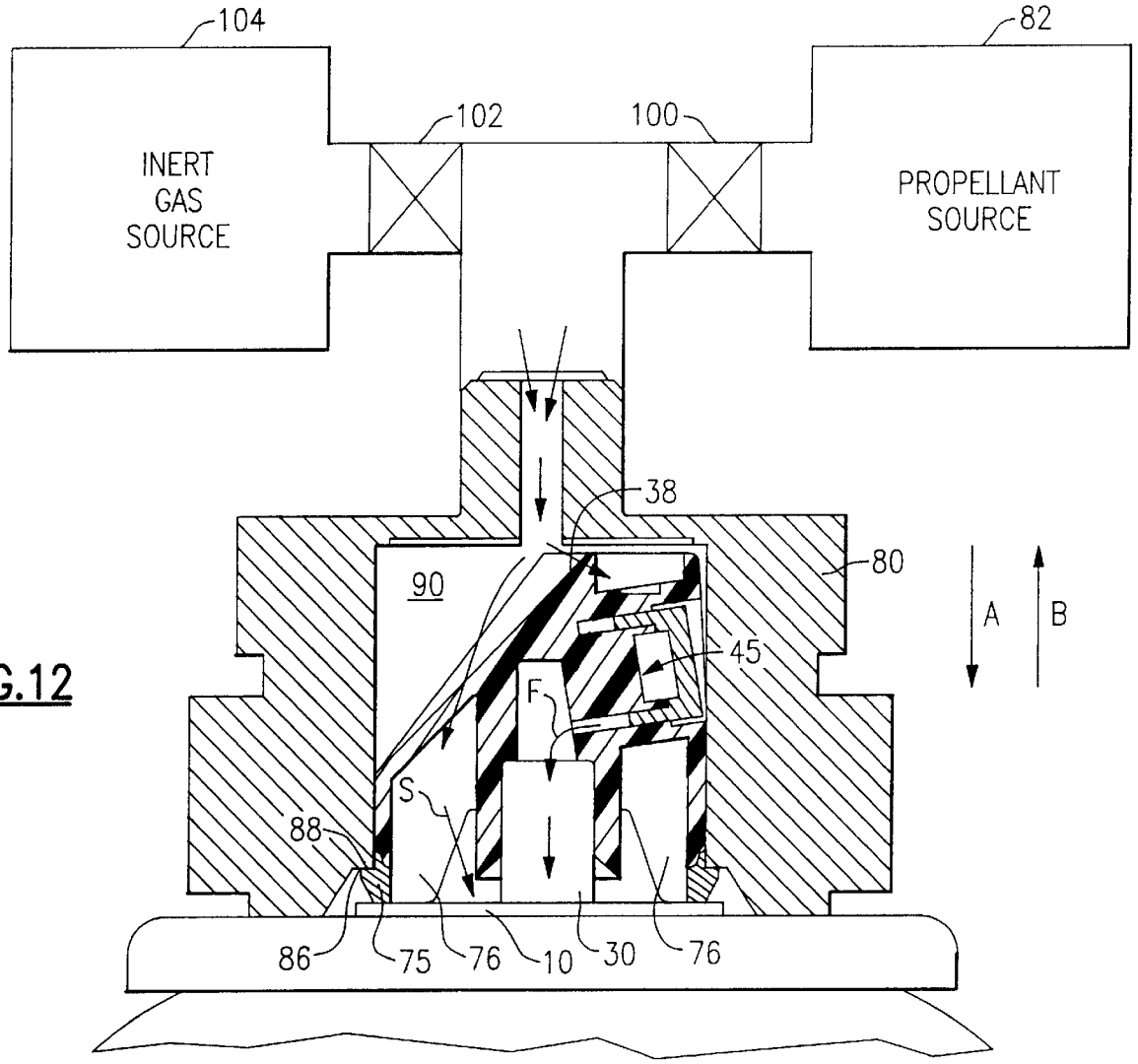
FIG. 12 is a diagrammatical cross-sectional view showing the flow path for the pressurized charging components during a button-on-filling process.

With reference to FIG. 12, a brief description concerning the charging process, utilizing the improved spray valve according to the first embodiment, will now be discussed. As can be seen in this Figure, the charging head 80 is connected to a source of propellent 82 under a relatively high pressure, e.g. 900 psig, and the charging head 80 is designed to completely surround and closely encompass the actuator 38 to facilitate charging of the pressurized container. A flange 86 of the charging head 80 engages with the mating outwardly facing tapered flange 88 provided on the exterior surface of the resilient skirt 75 of the actuator 38 during the initial engagement between those components. As the charging head 80 is lowered further, the resilient skirt portion 75 is forced into engagement with the top surface of the mounting cup 10 and a suitable seal is achieved between those three components. Due to the flared and inclined configuration of the resilient skirt portion 75, the resilient skirt portion 75 is substantially compressed and forms a suitable seal both with the downwardly facing surface of the flange 86 of the charging head 80 and the top surface of the mounting cup 10.

Thereafter, charging of the pressurized charging components, from the propellent source 82 can then occur through the provided longitudinal passageways 70, typically three or four longitudinal passageways are provided, as well as through the discharge outlet 40 of the actuator 38, as previously described. Once the charging process is completed, the supply of the propellent source is shut off by closing a first valve 100 and a subsequent purging step is initiated by opening a second valve 102 to provide a source of purging gas to the interior cavity 90 of the charging head 80 from an inner purging gas source 104. The inert purging gas, e.g. nitrogen, then flows into interior cavity of the charging head 80 and flows down through each one of the longitudinal passageways 70 into each of the formed internal compartments 73 of the actuator 38. This inert purging gas forces any remaining accumulated or trapped pressurized charging components along either the first and second established flow paths F, S into the interior of the container 20 being filled. The purging cycle is only active for a very short time period. The purging step insures that once the charging process is complete and the charging head 80 is removed from engagement with the actuator 38, any gas which is trapped or stored within any of the formed internal compartments 73 and thereafter released into the atmosphere will be solely inert purging gas, e.g. nitrogen, and not any of the potentially hazardous pressurized charging components.

It is to be appreciated that while the present invention is disclosed with reference to tilt valves, it is equally applicable to vertical valves, i.e. valves which are vertically depressible along a central axis of the assembly valve. In addition, the particular shape or design of the actuator can vary from application to application.

Since certain changes may be made in the above described actuators and filling process, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I/we claim:

1. An actuator for facilitating filling of an aerosol container by a button-on-filling process, the actuator comprising:

an exterior housing having an outer wall with a product discharge outlet formed therein, the exterior housing further having central post supporting an internal bore establishing communication between a product inlet and the product discharge outlet to facilitate dispensing an aerosol product via the actuator;

at least two spaced apart reinforcement ribs interconnecting the exterior housing with the central post and thereby defining at least two internal compartments within the actuator;

a base of the exterior housing having an annular skirt portion; and at least two openings for facilitating filling of a pressurizable container, via the actuator, during a button-on-filling process;

wherein each formed internal compartment of the actuator communicates with one of the at least two openings to facilitate filling of the pressurizable container.

2. The actuator according to claim 1, wherein there are at least four spaced apart reinforcements ribs which interconnect the exterior housing with the central post and partition a head space of the actuator in to four internal compartments, and each internal compartment communicates with one of the at least two openings to facilitate button-on-filling and purging of the filling components following completion of the button-on-filling process.

3. The actuator according to claim 2, wherein each of the internal compartments is defined by a pair of adjacent but spaced apart reinforcement ribs, an exterior surface of the central post, an inwardly facing surface of the exterior housing, and a lower downwardly facing interior surface of the actuator.

4. The actuator according to claim 1, wherein a lower downwardly facing surface of each of the reinforcement ribs is located to engage with a top surface of a mounting cup, during the button-on-filling process, to prevent an over stroke of a valve assembly, supported by the mounting cup, during the button-on-filling process.

5. The actuator according to claim 4, wherein the actuator has a wall thickness of about 0.020 inches to about 0.030 inches.

6. The actuator according to claim 1, wherein the actuator is manufactured from one of nylon, polypropylene and acetyl.

7. The actuator according to claim 1, wherein an insert member, which has a discharge orifice therein, is received within the discharge outlet to facilitate discharge of the product to be dispensed in a desired spray pattern.

8. The actuator according to claim 1 in combination with a valve assembly, the valve assembly comprises:

a mounting cup having a centrally located aperture surrounded by a pedestal, and the mounting cup includes a perimeter curl for attaching the mounting cup to a rim of a desired container;

an upstanding valve stem extends through the central aperture and has a valve outlet, and the valve assembly is crimped to the mounting cup so as to be permanently retained thereby with the upstanding valve stem extending through the central aperture;

the valve stem frictionally engages with the product inlet of the actuator to establish a product flow path therebetween;

the valve assembly has a valve product inlet which communicates with the valve product outlet for supplying product to be discharged through the valve assembly; and the valve assembly accommodates a normally closed valve element for controlling the flow of product from the valve product inlet to the valve product outlet.

9. The actuator according to claim 8, wherein a dip tube is connected to the valve product inlet for supplying the product to be dispensed by the valve assembly to the valve product inlet.

10. The actuator according to claim 8, wherein a gasket is located between an inwardly facing surface of the mounting cup and an adjacent surface of the valve assembly to provide a seal therebetween and prevent escape of a pressurized component.

11. The actuator according to claim 8, wherein the valve assembly is one of a tilt valve and a vertical valve.

12. A process for charging a pressurized container with propellant, the process comprising the steps of:

supporting a valve assembly via a mounting cup;

installing an actuator with an exterior housing having an outer wall with a product discharge outlet formed therein, the exterior housing further having a central post supporting an internal bore establishing communication between a product inlet and the product discharge outlet to facilitate dispensing an aerosol product via the actuator;

interconnecting the exterior housing with the central post with at least two spaced apart reinforcement ribs thereby to define at least two internal compartments;

providing a base of the exterior housing with an annular skirt portion for facilitating sealing engagement with a pedestal of a mounting cup during a button-on-filling process;

providing at least two openings for facilitating filling of an aerosol container by the button-on-filling process;

securing the mounting cup to a base container via a crimping process to form a pressurizable container;

biasing a base of the actuator, via a charging head, toward a top surface of the mounting cup; and supplying at least one pressurized component from the charging head to an interior of the pressurizable container, along at least one flow path through at least one of the two openings, to form the pressurized container.

13. The process according to claim 12, further comprising the step of providing at least two flow paths from the charging head to the interior of the pressurizable container to facilitate rapid charging of the pressurizable container with the at least one pressurized component.

14. The process according to claim 12, further comprising the step of, prior to withdrawing the charging head from the actuator, supplying a purging gas to the actuator to purge any remaining pressurized component from each formed internal compartment and minimize discharge of the at least one pressurized component into a surrounding production facility environment; and using nitrogen as the purging gas.

15. The process according to claim 12, further comprising the steps of supplying the at least one pressurized component at a filling pressure of about 900 psig; and filling each pressurizable container with an adequate quantity of the at least one pressurized component at a filling flow rate of about 100 cubic centimeters per second.

16. An actuator for facilitating filling of an aerosol container by a button-on-filling process, the actuator comprising:

an exterior housing having a product discharge outlet formed therein, the exterior housing supporting a central post having an internal bore establishing communication between a product inlet, of the actuator, and the product discharge outlet to facilitate dispensing an aerosol product via the actuator;

at least two spaced apart reinforcement ribs interconnecting the exterior housing with the central post and the at least two spaced apart reinforcement ribs dividing an interior space of the actuator into at least two internal compartments;

a base of the exterior housing having an annular skirt portion; and at least two openings in the actuator for facilitating filling of a pressurizable container during a button-on-filling process;

wherein each formed internal compartment of the actuator communicates with one of the at least two openings to facilitate filling of the pressurizable container.

17. The actuator according to claim 16, wherein at least four spaced apart reinforcement ribs interconnect the exterior housing with the central post and partition a head space of the actuator into four internal compartments, and each internal compartment communicates with one of the at least two openings to facilitate button-on-filling and purging of the filling components following completion of the button-on-filling process.

18. The actuator according to claim 16, wherein a lower downwardly facing surface of each of the reinforcement ribs is located to engage with a top surface of a mounting cup, during the button-on-filling process, and prevent an over stroke of a valve assembly, supported by the mounting cup, during the button-on-filling process.

19. The actuator according to claim 16, wherein an insert member, which has a discharge orifice therein, is received within the discharge outlet to facilitate discharge of the product to be dispensed in a desired spray pattern.

20. The actuator according to claim 16, wherein the actuator is manufactured from one of nylon, polypropylene and acetyl.

21. An actuator for facilitating filling of an aerosol container by a button-on-filling process, the actuator comprising:

an exterior housing having an outer wall with a product discharge outlet formed therein, the exterior housing further having central post supporting an internal bore establishing communication between a product inlet and the product discharge outlet to facilitate dispensing an aerosol product via the actuator;

at least two spaced apart reinforcement ribs interconnecting the exterior housing with the central post and thereby defining at least two internal compartments within the actuator;

a base of the exterior housing having an annular skirt portion; and at least one opening in the actuator for facilitating filling of a pressurizable container, via at least one of the at least two internal compartments of the actuator, during a button-on-filling process;

wherein each formed internal compartment of the actuator communicates with the at least one opening, during the button-on-filling process, to facilitate purging of each one of the at least two internal compartments prior to completion of the button-on-filling process.

22. An actuator for facilitating filling of an aerosol container by a button-on-filling process, the actuator comprising:

an exterior housing having an outer wall with a product discharge outlet formed therein, the exterior housing further having central post supporting an internal bore establishing communication between a product inlet and the product discharge outlet to facilitate dispensing an aerosol product via the actuator;

at least two spaced apart reinforcement ribs interconnecting the exterior housing with the central post and thereby defining at least two internal compartments within the actuator;

a base of the exterior housing having an annular skirt portion; and at least one opening for facilitating filling of a pressurizable container, via at least one of the at least two internal compartments of the actuator, during a button-on-filling process;

wherein a bottom edge of each of the at least two spaced apart reinforcement ribs is suitably spaced from a bottom of the base of the exterior housing, during the button-on-filling process, so that each formed internal compartment of the actuator communicates with the at least one opening to facilitate purging of each one of the at least two internal compartments following completion of the button-on-filling process and minimize accumulation of any pressurized filling component in the at least two internal compartments following completion of the button-on-filling process.

* * * * *